United States Patent [19]

Overman

[11] 4,416,981

[45] Nov. 22, 1983

[54] BENZOTHIAZOLINE DERIVATIVES AS SILVER HALIDE ANTIFOGGANTS

[75] Inventor: Joseph D. Overman, Wilmington, Del.

[73] Assignee: E. I. Du Pont de Nemours & Co., Wilmington, Del.

[21] Appl. No.: 373,280

[22] Filed: Apr. 29, 1982

[51] Int. Cl.[3] ..... G03C 1/34

[52] U.S. Cl. ..... 430/614; 430/966

[58] Field of Search ..... 430/613, 600, 489, 551, 430/966, 446, 448, 614

[56] References Cited

U.S. PATENT DOCUMENTS

| | | | |
|---|---|---|---|
| 2,131,038 | 9/1938 | Brooker et al. | 430/614 |
| 3,545,971 | 12/1970 | Barnes et al. | 430/966 |
| 3,652,277 | 3/1972 | Hara et al. | 96/50 |
| 3,677,761 | 7/1972 | Brown et al. | 96/66.5 |

*Primary Examiner*—Won H. Louie, Jr.

[57] ABSTRACT

Substituted benzothiazolines are used as antifoggants in high speed silver halide emulsions.

4 Claims, No Drawings

BENZOTHIAZOLINE DERIVATIVES AS SILVER HALIDE ANTIFOGGANTS

BACKGROUND OF THE INVENTION

1. Field of the Invention

This invention relates to high speed, photographic silver halide emulsions and film elements prepared therefrom. Specifically, this invention relates to films with reduced silver halide coating weights and compounds which can be used to reduce fog.

2. Description of the Prior Art

Antifogging compounds useful in silver halide systems are legion in number in the prior art. These compounds are useful in conventional systems sensitized with gold and sulfur compounds, for example. Currently, however, there is a pressing need to reduce silver halide coating weight in order to conserve coats and finite resources. One way of accomplishing this reduction in coating weight is to further sensitize the emulsion in order to raise the speed of the film prepared, using smaller silver halide crystals which give higher covering power but otherwise would have lower speed. Addition of more sensitizer also increases fog. Fog can be reduced by adding more of the conventional antifoggant but these antifoggants also reduce emulsion speed. This is a common problem and one which has bothered the emulsion/film making field for some time.

It is an object of this invention to provide a novel class of compounds particularly useful as antifoggants in silver halide emulsions. It is another object to provide silver halide emulsion antifoggants which are particularly efficacious in high speed, low coating weight film elements made from these emulsions.

SUMMARY OF THE INVENTION

These and other objects are achieved by providing a photographic element comprising a support containing a silver halide emulsion coated thereon, characterized in that said emulsion contains an antifogging amount of a benzothiazoline derivative of the formula

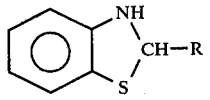

wherein R is H, alkyl, aryl, or substituted alkyl or aryl. These emulsions can be highly sensitized and thus coated at a reduced silver halide coating weight. The level of fog can be greatly reduced without substantial speed loss by the addition of the compounds of this invention.

DETAILED DESCRIPTION OF THE INVENTION

Benzothiazoline derivatives may be conveniently made using the following reaction:

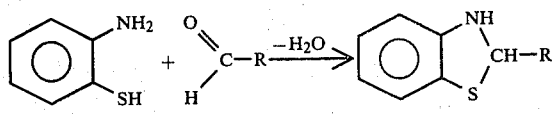

where R may be hydrogen, alkyl, aryl, or substituted alkyl or aryl. Examples of compounds made in this manner and useful as antifoggants within the ambit of this invention include, among others, the following:

(A)

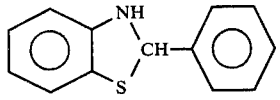

(B)

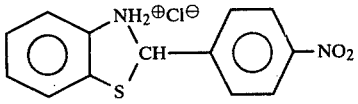

(C)

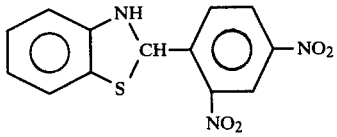

(D)

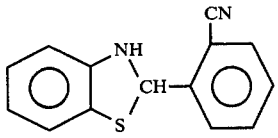

(E)

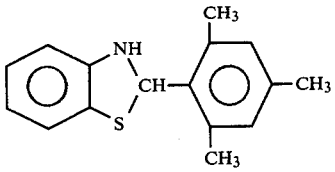

(F)

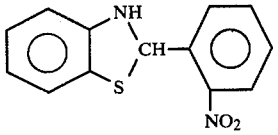

(G)

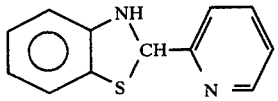

(H)

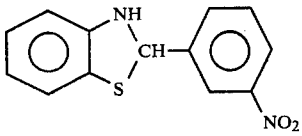

These compounds and the salts thereof may be added to any gelatino-silver halide emulsion to function usefully as antifoggants. Preferably, they are added individually dissolved in suitable solvents after the emulsion has been fully sensitized and just prior to coating the emulsion on a support. Preferably, solvents miscible with water are used. The compounds and salts thereof may be used in amounts from about 0.0005 g to 0.1 g per 1.5 moles of silver halide (known as a "unit of emulsion") to achieve antifogging action. An optimum range is 0.001 g to 0.09 g/unit of emulsion.

As stated previously, any of the commonly used gelatin-silver halide emulsions can be used in the practice of this invention, e.g., silver bromide, silver chloride, silver iodide or mixed halides. The emulsions may be sensitized with sulfur, gold, or polyethylene oxide, for example, along with other commonly used sensitizers.

A particular group of effective sensitizers are the derivatives of my copending application (PD-1908), filed Mar. 29, 1982 as Ser. No. 363,378, in particular, 2-[4-methoxyphenyl]-thiazolidine and cysteamine. When these sensitizers are used as taught in this reference, the speed of an X-ray emulsion, for example, can be increased up to 40%. Thus, it is possible to prepare a photographic film of equivalent sensitivity using lower silver halide coating weights.

The emulsions of this invention may also contain wetting agents, hardeners, other antifoggants, dyes and other common adjuvants well known to those skilled in the art. Commonly used binders (e.g., gelatin, hydrolyzed PVA, etc.) may also be efficaciously used in the making of these emulsions.

The emulsions of this invention may be coated on any of the commonly used film supports such as polyethylene terephthalate, cellulosic films, etc. The preferred support is dimensionally stable polyethylene terephthalate film, suitably subbed (subcoated) as described in the prior art.

This invention is illustrated by the following Examples of which Example 1 is considered the best mode:

EXAMPLE 1

A coarse grained gelatino-silver iodobromide emulsion of the type used in medical X-ray films was prepared, specifically an emulsion containing ca. 98 mole % AgBr and ca. 2 mole % AgI with about 5 weight % of gelatin and about 10 weight % of silver halide. The emulsion was fully sensitized by digestion at elevated temperatures with sodium thiocyanate and gold thiocyanate. After digestion, the usual wetting agents, coating aids, and antifoggants were added and the emulsion split into three portions. One portion was coated without further treatment (Control I). One portion was further sensitized by the addition of cysteamine hydrochloride and then coated (Control II). The third sample (III) was treated with cysteamine hydrochloride followed by the addition of Antifoggant C, above.

All three emulsion samples were coated on clear 0.007 inch (0.018 cm) thick biaxially oriented and heat-relaxed polyethylene terephthalate film supports. The film supports had been subbed on each side with a conventional resin subbing layer (e.g., a vinylidene chloride/methyl acrylate/itaconic acid copolymer mixed with a methyl acrylate polymer) over which a thin anchoring substratum of hardened gelatin had been coated (about 0.5 mg/dm$^2$). The emulsion was applied on one side of the film support at a coating weight of about 50 mg/dm$^2$ of silver bromide and about 10 mg/dm$^2$ abrasion layer of hardened gelatin applied thereon.

Sample strips from each coating were then exposed through a $\sqrt{2}$ step wedge for $10^{-2}$ seconds on a Mark 6 Sensitometer produced by E. G. and G. Co. (GE Type FT-118 Xenon Flash Tube) containing a 2.0 neutral density filter and a No. 207763, $10^{-2}$ compensating attenuating grid. The exposed strips were then developed for 3 minutes at room temperature in a standard X-ray type developer (phenidone/hydroquinone), fixed, and dried. The following results were obtained:

| Sample | Cysteamine Hydrochloride (g/unit) | Antifoggant* C(g/unit) | Rel. Speed | Gamma | Fog |
|---|---|---|---|---|---|
| I - Control | None | None | 100 | 1 | 0.04 |
| II - Control | 0.0125 | None | 282 | 0.8 | 0.08 |
| III of this invention | 0.0125 | 0.001 | 162 | 0.9 | 0.04 |

*Dissolved in ethanol

The effect of the antifoggant is readily apparent.

EXAMPLE 2

An emulsion was made according to the teachings of Example 1 and split into 7 portions. Cysteamine hydrochloride and Antifoggant B were added to certain portions in varying amounts and the emulsions were coated, dried, exposed, developed and exposed as in Example 1, with the following results:

| Sample | Cysteamine Hydrochloride (g/unit) | Antifoggant* B(g/unit) | Rel. Speed | Gamma | Fog |
|---|---|---|---|---|---|
| I - Control | None | None | 100 | 0.8 | 0.01 |
| II | 0.005 | None | 141 | 0.7 | 0.03 |
| III | 0.0075 | None | 141 | 0.7 | 0.06 |
| IV | 0.010 | None | 174 | 0.6 | 0.10 |
| V | 0.005 | 0.04 | 115 | 0.7 | 0.02 |
| VI | 0.0075 | 0.04 | 141 | 0.7 | 0.02 |
| VII | 0.010 | 0.04 | 141 | 0.7 | 0.04 |

This example demonstrates that acceptable speeds and acceptable fog levels can be achieved with the antifoggants of this invention.

EXAMPLE 3

An emulsion was made as taught in Example 1 except that cysteamine hydrochloride (0.007 g/unit) was also added. The emulsion was split into seven portions. One was kept as control. To the rest, several of the antifoggants of this invention were added as shown below just before coating and exposing as taught in Example 1. Development time was increased to 4 minutes in this example. The following results were obtained:

| Sample | Antifoggant added | Antifoggant* Amt. (g/unit) | Rel. Speed | Gamma | Fog |
|---|---|---|---|---|---|
| I - Control | None | — | 100 | 0.9 | 0.07 |
| II | A | 0.04 | 46 | 0.9 | 0.03 |
| III | A | 0.08 | 43 | 0.9 | 0.02 |
| IV | F | 0.04 | 57 | 0.8 | 0.03 |
| V | F | 0.08 | 57 | 0.6 | 0.02 |
| VI | E | 0.04 | 57 | 0.47 | 0.01 |
| VII | E | 0.08 | 40 | 0.8 | 0.01 |

*Dissolved in acetone

EXAMPLE 4

An emulsion was made according to Example 1 and split into five portions. One portion was coated without further treatment (control). Cysteamine hydrochloride (0.015 g/unit) was added to each of the remaining four (4) portions along with varying amounts of Antifoggant C. The samples were coated, exposed and developed as taught in Example 1 with the following results:

| Sample | Antifoggant C* Amt. (g/unit) | Rel. Speed | Gamma | Fog |
|---|---|---|---|---|
| I - Control | None | 100 | 0.7 | 0.01 |
| II - Control | None | 230 | 0.6 | 0.03 |
| III | 0.00075 | 200 | 0.6 | 0.02 |
| IV | 0.0011 | 200 | 0.7 | 0.01 |
| V | 0.0015 | 162 | 0.8 | 0.01 |

*Dissolved in ethanol

EXAMPLE 5

An emulsion was made according to Example 1 and split into three portions. One portion was coated without further treatment (control). Varying amounts of Antifoggant B dissolved in acetone were added to the other portions. Coating, exposure, and development were the same as Example 1. The following results were obtained:

| Sample | Antifoggant B Amt. (g/unit) | Rel. Speed | Gamma | Fog |
|---|---|---|---|---|
| I - Control | None | 100 | 1.5 | 0.06 |
| II | 0.024 | 94 | 1.5 | 0.03 |
| III | 0.048 | 87 | 1.5 | 0.02 |

EXAMPLE 6

An emulsion was made according to Example 1 and split into three portions. I, the Control, was coated without further treatment. II contained 0.0125 g/unit of cysteamine hydrochloride. III contained 0.0125 g/unit cysteamine hydrochloride plus 0.04 g/unit of Antifoggant D dissolved in ethanol.

The emulsions were coated, exposed and developed as previously described. The following results were obtained:

| Sample | Rel. Speed | Gamma | Fog |
|---|---|---|---|
| I - Control | 100 | 1.0 | 0.01 |
| II | 200 | 0.7 | 0.08 |
| III | 200 | 0.5 | 0.06 |

EXAMPLE 7

An emulsion made according to Example 1 was split into six portions. One portion was coated without further treatment (control). Cysteamine hydrochloride was added to each of the other portions at 0.015 g/unit. Varying antifoggants were added to these portions in varying amounts. Each portion was coated, exposed and developed as previously described. The following results were obtained:

| Sample | Anti-foggant added | Antifoggant* Amt. (g/unit) | Rel. Speed | Gamma | Fog |
|---|---|---|---|---|---|
| I - Control | None | None | 100 | 0.8 | 0.01 |
| II | None | None | 174 | 0.7 | 0.04 |
| III | G | 0.03 | 152 | 0.8 | 0.01 |
| IV | G | 0.06 | 141 | 0.8 | 0.01 |
| V | H | 0.03 | 174 | 0.6 | 0.03 |
| VI | H | 0.06 | 141 | 0.6 | 0.03 |

*Dissolved in ethanol

EXAMPLE 8

An emulsion was made according to Example 1 and split into three portions. One portion was coated without further treatment (control). L-cysteine. HCl hydrate was added to the other two portions (0.048 g/unit). Antifoggant C dissolved in ethanol (0.001 g/unit) was also added to the last portion. Each portion was coated, exposed and developed as described in Example 1 with the following results:

| Sample | Rel. Speed | Gamma | Fog |
|---|---|---|---|
| I - Control | 100 | 0.8 | 0.01 |
| II | 152 | 0.8 | 0.06 |
| III | 108 | 0.9 | 0.01 |

I claim:

1. A photographic element comprising a support containing a silver halide emulsion coated thereon, characterized in that said emulsion contains an antifogging amount of a benzothiazoline derivative of the formula

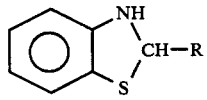

wherein R is H, alkyl, aryl, or substituted alkyl or aryl.

2. The photographic element of claim 1 wherein said benzothiazoline derivative is selected from the following:

(A)

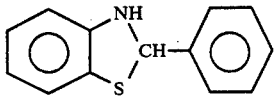

(B)

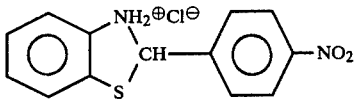

(C)

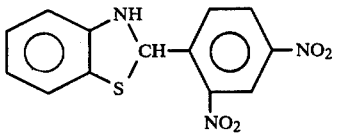

(D)

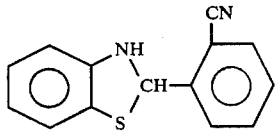

(E)

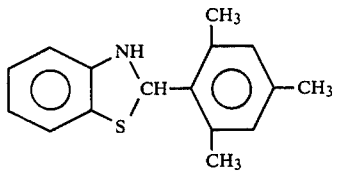

-continued
(F)
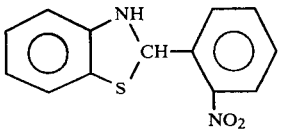
(G)
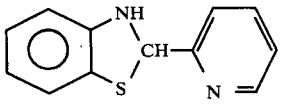
-continued
(H)
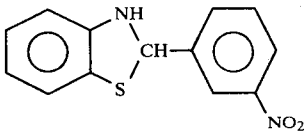
3. The photographic element of claim 1 or 2 wherein said benzothiazoline derivative is present in amounts from about 0.0005 g to 0.1 g per 1.5 moles of silver halide.
4. The photographic element of claim 3 wherein said benzothiazoline derivative is present in the amount of 0.001 g to 0.09 g/unit of emulsion.
* * * * *